US005875769A

United States Patent [19]

Toyama et al.

[11] Patent Number: 5,875,769

[45] Date of Patent: Mar. 2, 1999

[54] METHOD OF SLICING SEMICONDUCTOR SINGLE CRYSTAL INGOT

[75] Inventors: Kohei Toyama, Shirakawa; Etsuo Kiuchi, Gunma-gun; Kazuo Hayakawa, Takasaki, all of Japan

[73] Assignee: Shin-Etsu Handotai Co., Ltd., Tokyo, Japan

[21] Appl. No.: 822,983

[22] Filed: Mar. 21, 1997

[30] Foreign Application Priority Data

Mar. 29, 1996 [JP] Japan ..... 8-075587

[51] Int. Cl.[6] ..... B28D 1/08

[52] U.S. Cl. ..... 125/16.01; 125/16.02; 451/41

[58] Field of Search ..... 125/16.01, 16.02; 451/41

[56] References Cited

U.S. PATENT DOCUMENTS

| | | | |
|---|---|---|---|
| 4,618,396 | 10/1986 | Shimoda et al. | 156/605 |
| 4,628,016 | 12/1986 | Yamaguchi | 430/30 |
| 5,052,366 | 10/1991 | Matsukura | 125/16.01 |
| 5,439,723 | 8/1995 | Miyashita et al. | 428/66.7 |

FOREIGN PATENT DOCUMENTS

| | | |
|---|---|---|
| 0 738 572 | 10/1996 | European Pat. Off. . |
| 1 104 074 | 4/1961 | Germany . |
| 131 102 | 5/1978 | Germany . |

OTHER PUBLICATIONS

Patent Abstracts of Japan, vol. 015, No. 120 (M–1096), Mar. 25, 1991, & JP 03 010760 A, (Nippon Spindle Mfg. Co., Ltd.), Jan. 18, 1991.

Patent Abstracts of Japan, vol. 018, No. 317 (M–162), Jun. 16, 1994, & JP 06 071639 A, (Toshiba Corp.), Mar. 15, 1994.

Duane O. Townley: "Optimum Crystallographic Orientation for Silicon Device Fabrication", Solid State Technology, vol. 16, No. 1, Jan. 1973, pp. 43–47.

Patent Abstracts of Japan, vol. 018, No. 427 (C–1235), Aug. 10, 1994, & JP 06 128092 A, (Toshiba Corp.), May 10, 1994.

*Primary Examiner*—Robert A. Rose
*Assistant Examiner*—George Nguyen
*Attorney, Agent, or Firm*—Nikaido, Marmelstein, Murray & Oram LLP

[57] ABSTRACT

A method of slicing a semiconductor single crystal ingot by a wire saw slicing apparatus and a semiconductor wafer produced by the method, in which the running direction of the wire is not corresponding with the cleavage directions of the semiconductor single crystal ingot so that occurrence of cracks or breakage in the semiconductor wafer produced by the method can be suppressed significantly without any additional processes or an increase in cost.

4 Claims, 6 Drawing Sheets

METHOD OF SLICING SEMICONDUCTOR SINGLE CRYSTAL INGOT

BACKGROUND OF THE INVENTION

1. Field of the Invention

The present invention relates to a method of slicing a semiconductor single crystal ingot with a wire saw slicing apparatus and a semiconductor single crystal wafer sliced by the method.

2. Description of the Related Art

There is known a wire saw slicing apparatus as a means for slicing brittle materials such as compound semiconductor crystal ingots and silicon semiconductor crystal ingots. The wire saw slicing apparatus, as shown in FIG. 4, includes three plastic main rollers 10A, 10B and 10C of the identical construction disposed with their axes parallel spaced from one another, and a wire 12 wound spirally around helical grooves 14*a*, 14*b* and 14*c* formed at regular intervals or pitches in the respective outer peripheral surfaces of the main rollers 10A–10C. The main rollers may be plural in number and should by no means be limited to any particular number, but four or three main rollers as in the illustrated embodiment are used in general. The main roller 10C constitutes a drive roller and is connected in driven relation to a drive motor 16. A rotary motion of the main roller 10C is transmitted via the wire 12 to the remaining main rollers 10A, 10B which constitute driven rollers.

The wire 12 has one or a leading end portion wound around a wire reel bobbin 22 via a tension adjustment mechanism 20. The wire reel bobbin 22 is rotatably driven by a torque motor 24. A tension on a portion of the wire 12 extending between the tension adjustment mechanism 20 and the wire reel bobbin 22 is regulated according to a voltage applied to the torque motor 24. And, a tension on a portion of the wire 12 running between the tension adjustment mechanism 20 and the drive roller 10C is adjusted at a constant value by the tension adjustment mechanism 20.

Similarly, the opposite or a trailing end portion of the wire 12 is wound around a wire reel bobbin 32 via a tension adjustment mechanism 30. The wire reel bobbin 32 is rotatably driven by a torque motor 34. A tension on a portion of the wire 12 extending between the tension adjustment mechanism 30 and the wire reel bobbin 32 is regulated according to a voltage applied to the torque motor 34. And, a tension on a portion of the wire 12 running between the tension adjustment mechanism 30 and the drive roller 10C is adjusted at a constant value by the tension adjustment mechanism 30.

A workpiece 40 is composed, for example, of a semiconductor single crystal ingot having an orientation flat and attached by bonding to a workpiece holder 42 via the orientation flat. The workpiece holder 42 is vertically moved up and down along a linear path.

The wire saw slicing apparatus of the above construction operates as follows. The drive roller 10C is rotated by the drive motor 16 to reciprocate the wire 12 in the axial or longitudinal direction thereof. A working fluid containing abrasive grains is supplied to a contact area between workpiece 40 and the wire 12. While keeping this condition, the workpiece 40 is further moved downwards whereby the workpiece 40 is sliced at one time into a multiplicity of wafers by a lapping action attained by the reciprocating wire 12 and the abrasive-grains containing working fluid supplied thereto.

It is known that a semiconductor single crystal cracks or cleaves in a fixed direction to form a smooth face, that is, a cleaved face. This cracking direction is called a cleavage direction which varies with the kind of the crystal.

For example, as shown in FIGS. 7 to 9, in case of a silicon single crystal (W), a plurality of cleavage directions (A) exist according to crystal orientations. FIG. 7 shows cleavage directions of a (100) silicon single crystal, FIG. 8 shows those of a (110) silicon single crystal and FIG. 9 shows those of a (111) silicon single crystal.

Conventionally, when a semiconductor single crystal ingot such as a silicon semiconductor single crystal ingot (hereinafter, may be merely referred to as "ingot") is sliced by the wire saw slicing apparatus, the slicing operation was conducted with the cleavage direction of the silicon single crystal ingot almost corresponding with the wire running direction.

For example, in case of slicing a (100) silicon single crystal ingot, as shown in FIGS. 5 and 6, first a back plate 41 is adhered to the orientation flat portion (OF) of the ingot (W), and then the adhered back plate 41 is adhered to the workpiece holder 42 (FIG. 5), or first the back plate 41 is adhered to the portion rotated or shifted by 90° from the orientation flat portion (OF) of the ingot (W), and then the adhered back plate 41 is adhered to the workpiece holder 42 (FIG. 6). Thereafter, the ingot (W) adhered to the holder 42 is moved down and pressed against the wire 12 of the wire saw slicing apparatus.

In this case, there are two cleavage directions ($A_1$, $A_2$) which are normal to each other when seen in the cross-section along the radial direction. In the (100) silicon single crystal, the orientation flat portion (OF) is mostly formed in either one of the two cleavage directions ($A_1$, $A_2$). With either one of the two cleavage directions ($A_1$, $A_2$) corresponding with the running direction (Y) of the wire 12, the ingot (W) is sliced.

The procedure of slicing the ingot (W) by the conventional wire saw slicing apparatus is described with reference to FIG. 4.

First, an ingot (W) is prepared (step 1). Next, the crystal orientation in the distal end face of the prepared ingot (W) is measured (step 2). A back plate 41 is adhered to the orientation flat portion (OF) or the portion rotated or shifted by 90° from the orientation flat portion (OF) of the ingot (W) (step 3). The back plate 41 adhered to the ingot (W) is further adhered to the workpiece holder 42 (step 4). Then, the ingot (W) which is incorporated with the back plate 41 and the workpiece holder 42 is secured to an attaching base 44 of the wire saw slicing apparatus (step 5). The attaching angle of the ingot (W) is adjusted in accordance with individual standards (step 6). Next, with the wire saw slicing apparatus, the ingot (W) is sliced to the central portion of the back plate 41 to produce a large number of sliced wafers (step 7). Thereafter, the ingot (W) is removed from the attaching base 43 of the wire saw slicing apparatus, with a large number of the sliced wafers being still adhered to the workpiece holder 42 (step 8). The removed ingot is soaked in hot water to separate a large number of the sliced wafers from the workpiece holder 42 (step 9). The separated wafers are cleaned to be as-cut wafers (step 10).

In the above-mentioned manner, as-cut wafers are prepared from the ingot (W). However, when the ingot (W) is sliced by the wire saw slicing apparatus, the traces of running of the wire are left as saw marks on the surface of each wafer with a result that damaged layers are formed along the saw marks. The damaged layers lead to occurrence of cracks along the cleavage directions in the sliced single crystal wafer by the wire vibration or the like effect. Thus, in the conventional slicing method, the sliced wafer is disadvantageously apt to be cracked because the saw marks run in accord with either one of the cleavage directions.

SUMMARY OF THE INVENTION

With the foregoing problems in view, it is an object of the present invention to provide a method of slicing a semiconductor single crystal ingot with a wire saw slicing apparatus, in which the saw marks left after running of the wire are not corresponding with the cleavage directions of the semiconductor single crystal ingot so that occurrence of cracks or breakage in the sliced semiconductor single crystal wafer can be prevented without any additional processes and an increase in cost.

Another object of the present invention is to provide a semiconductor single crystal wafer with extremely few occurrence of cracks or breakage.

According to the present invention, there is provided a method of slicing a semiconductor single crystal ingot by a wire saw slicing apparatus, in which the running direction of the wire of the wire saw slicing apparatus is not corresponding with the cleavage directions of the semiconductor single crystal ingot.

Preferably, the running direction of the wire is not corresponding with any one of a plurality of cleavage directions of the semiconductor single crystal ingot, and the angle θ to be defined between the wire running direction and any one of the cleavage directions is 5° or more.

There is also provided a semiconductor single crystal wafer which is produced by slicing a semiconductor single crystal ingot by the above method with the wire running direction of the wire saw apparatus being not corresponding with any one of the cleavage directions of the ingot and has saw marks which are not corresponding with any one of the cleavage directions of the semiconductor single crystal. Therefore, occurrence of cracks and breakage of the wafers of the present invention can be suppressed significantly.

These and other objects, features and advantages of the present invention will be more apparent from the following description of a preferred embodiment, taken in conjunction with the accompanying drawings.

DETAILED DESCRIPTION

Hereinafter, a preferred embodiment of the present invention will be described with reference to the accompanying drawings.

In this case, a (100) silicon single crystal ingot will be described as an example of a semiconductor single crystal ingot. As shown in FIG. 2 and FIGS. 5 to 7, in the (100) silicon single crystal ingot (W), there are two cleavage directions normal to each other. As described above, the orientation flat portion (OF) of the ingot (W) is formed in accord with either one of the two cleavage directions.

Figure 6:
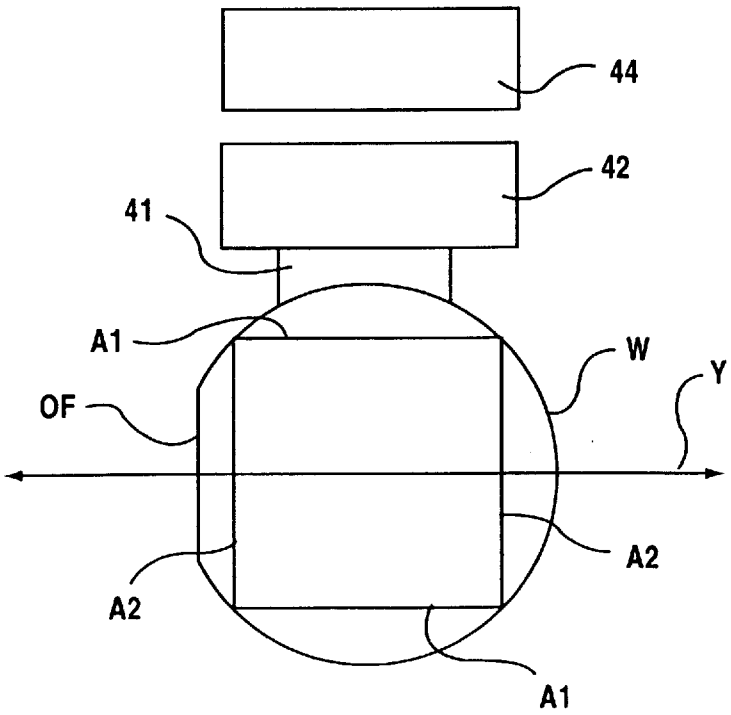
FIG.6 PRIOR ART
FIG. 6 is a schematic diagram showing another example of relationship between the ingot cleavage directions and the wire running direction according to the conventional method.
Figure 5:
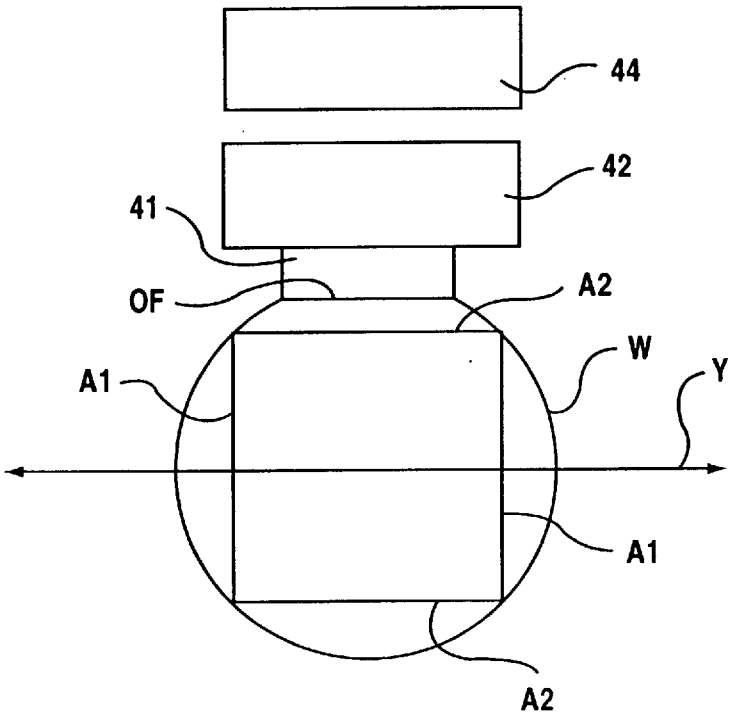
FIG.5 PRIOR ART
FIG. 5 is a schematic diagram showing one example of relationship between the ingot cleavage directions and the wire running direction according to the conventional method.
Figure 7:
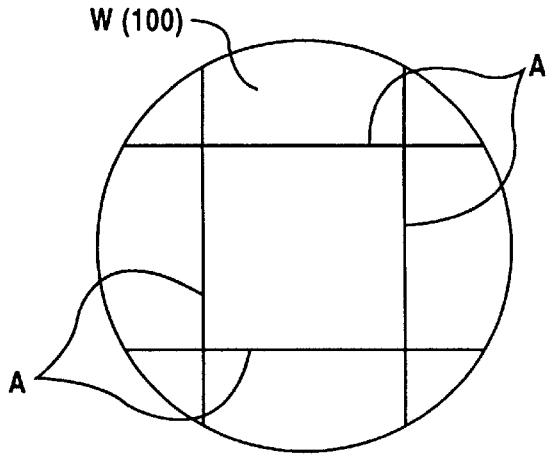
FIG.7 PRIOR ART
FIG. 7 shows cleavage directions of a (100) silicon single crystal.
Figure 8:
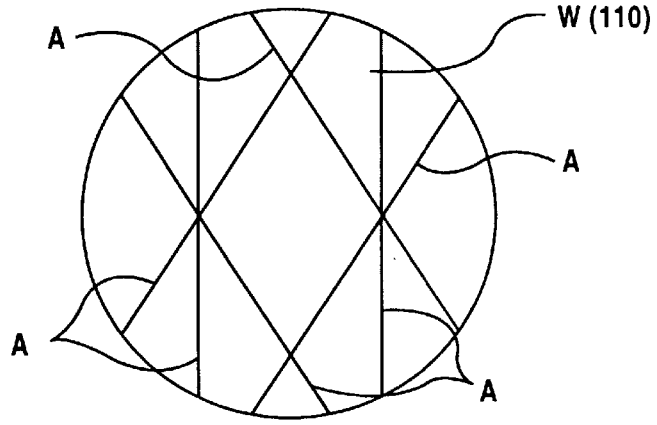
FIG.8 PRIOR ART
FIG. 8 shows cleavage directions of a (110) silicon single crystal.
Figure 9:
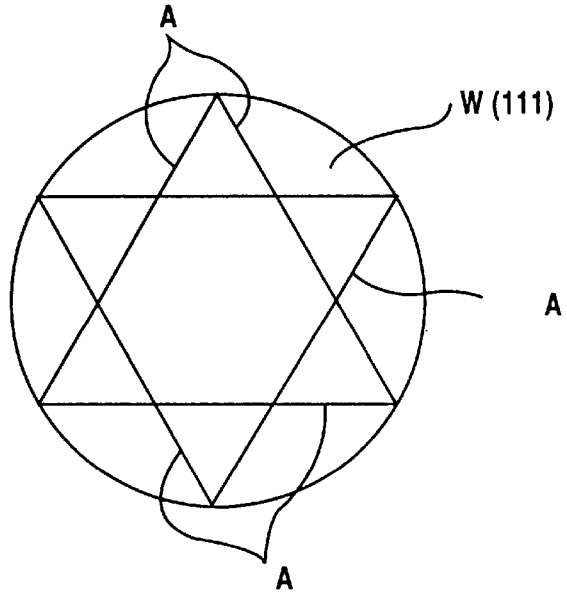
FIG.9 PRIOR ART
FIG. 9 shows cleavage directions of a (111) silicon single crystal.

Conventionally, the back plate 41 was adhered to the orientation flat portion (OF) of the ingot (W) (FIG. 5), or it was adhered to the portion rotated or shifted by 90° from the orientation flat portion (OF) of the ingot (W)(FIG. 6). Namely, the back plate 41 was adhered to the ingot (W) in accord with either one of the two cleavage directions.

Then, the ingot (W) was moved down vertically to the back plate 41 to be sliced by the wire 12 of the wire saw slicing apparatus. In this case, since the running direction (Y) of the wire 12 is arranged in accord with one of the cleavage directions of the ingot (W) as describe above, cracks or breakage may occur in the wafers to be produced by slicing the ingot (W).

Figure 2:
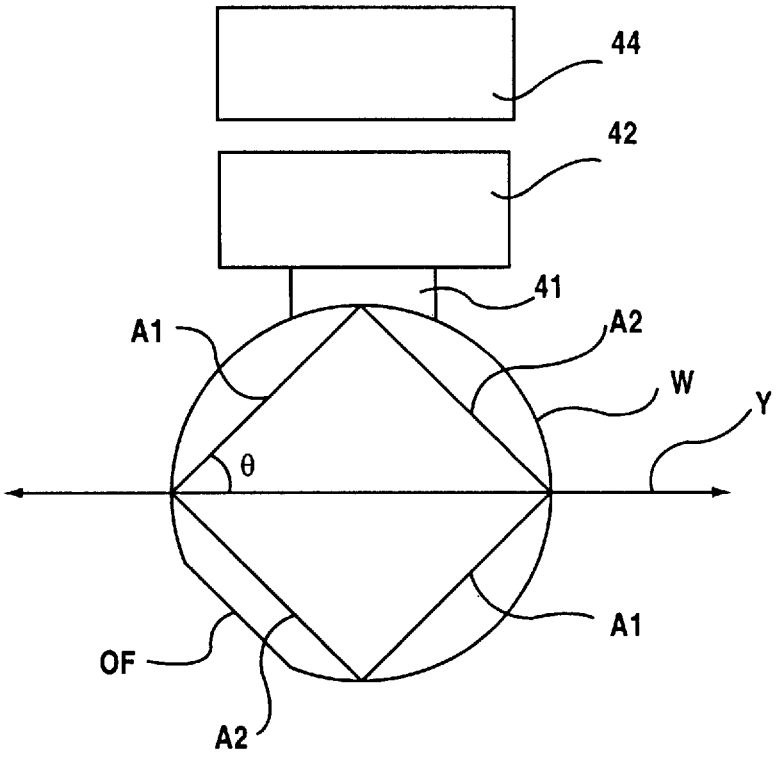
FIG. 2 is a schematic diagram showing the ingot cleavage directions and the wire running direction according to the present invention.

In the present invention, as shown in FIG. 2, the backplate 41 is adhered to neither the orientation flat portion (OF) nor the portion rotated or shifted by 90° from the orientation flat portion (OF). Namely, in the present invention, the back plate 41 is first adhered to a portion other than the orientation flat portion (OF) or a portion rotated or shifted by 90° from the orientation flat portion (OF), and is then adhered to the workpiece holder 42. In the case of FIG. 2, the angle θ defined between either one, for example ($A_1$), of the two cleavage directions ($A_1$, $A_2$) of the ingot (W) and the running direction (Y) of the wire 12 of the wire saw slicing apparatus is illustrated as 45°.

If the ingot (W) is adhered to the workpiece holder 42 and sliced by the wire saw slicing apparatus as shown in FIG. 2, the saw mark formed in the wafer by the wire 12 of the wire saw slicing apparatus is not corresponding with either one of the cleavage directions of the ingot (W). Therefore, occurrence of cracks or breakage in the wafers which are produced by slicing the ingot (W) can be prevented. The running direction (Y) of the wire 12 of the wire saw slicing apparatus and the cleavage directions ($A_1$, $A_2$) are not corresponding with each other. The angle (θ in FIG. 2) defined 10 between the running direction (Y) of the wire 12 and either one of the two cleavage directions ($A_1$, $A_2$) of the ingot (W) is not 0° or 90° where both of the running direction (Y) of the wire 12 and either one of the two cleavage directions ($A_1$, $A_2$) are corresponding with each other, that is, the range of the angle θ applicable to the resent invention is shown by the equation: $0°<\theta<90°$.

The larger the angle or separation between the wire running direction (Y) and the cleavage direction of the ingot (W) is, the fewer the cracks or breakage in the wafer produced by slicing the ingot(W) may occur. Therefore, the most preferred value of θ is 45° but in the case where the angle is in the range of $5° \leqq \theta \leqq 85°$, occurrence of cracks or breakage in the wafers produced by slicing the ingot can be prevented sufficiently.

Figure 1:
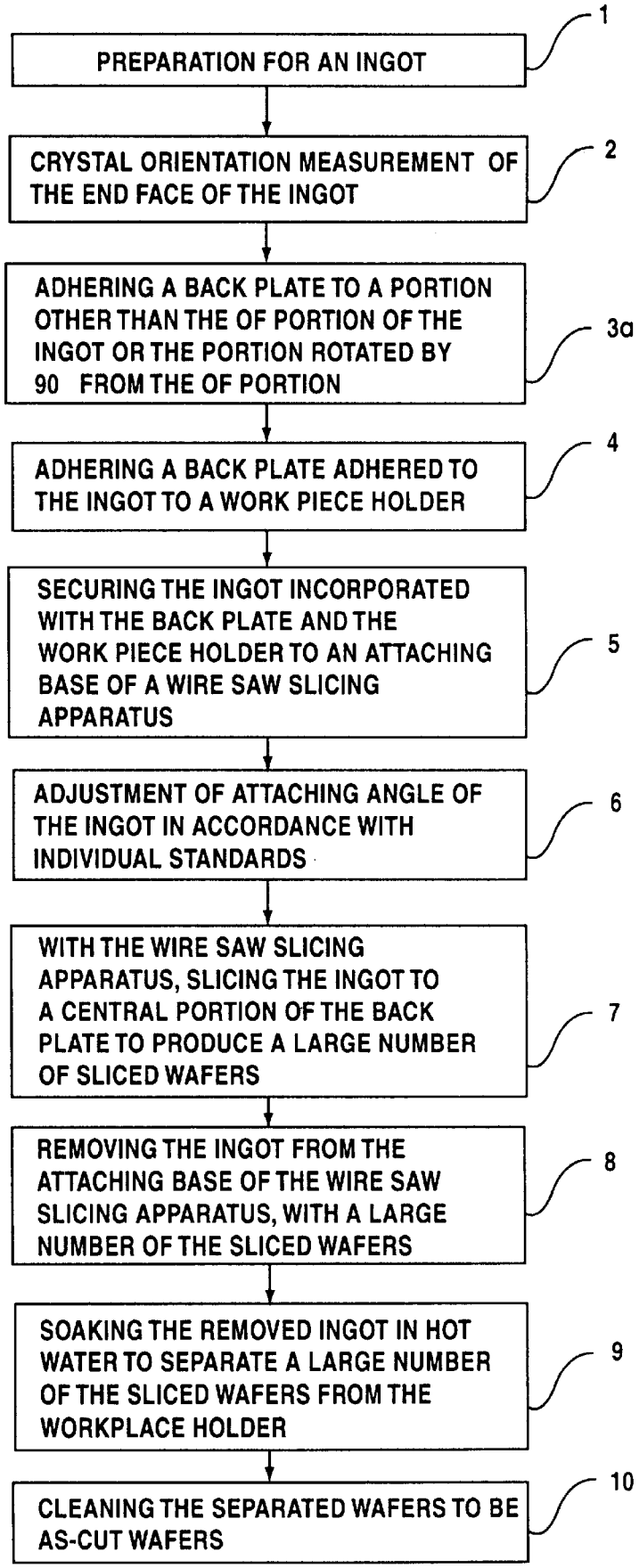
FIG. 1 is a flow chart showing a procedure of a method of slicing a semiconductor single crystal ingot according to the present invention.
Figure 4:
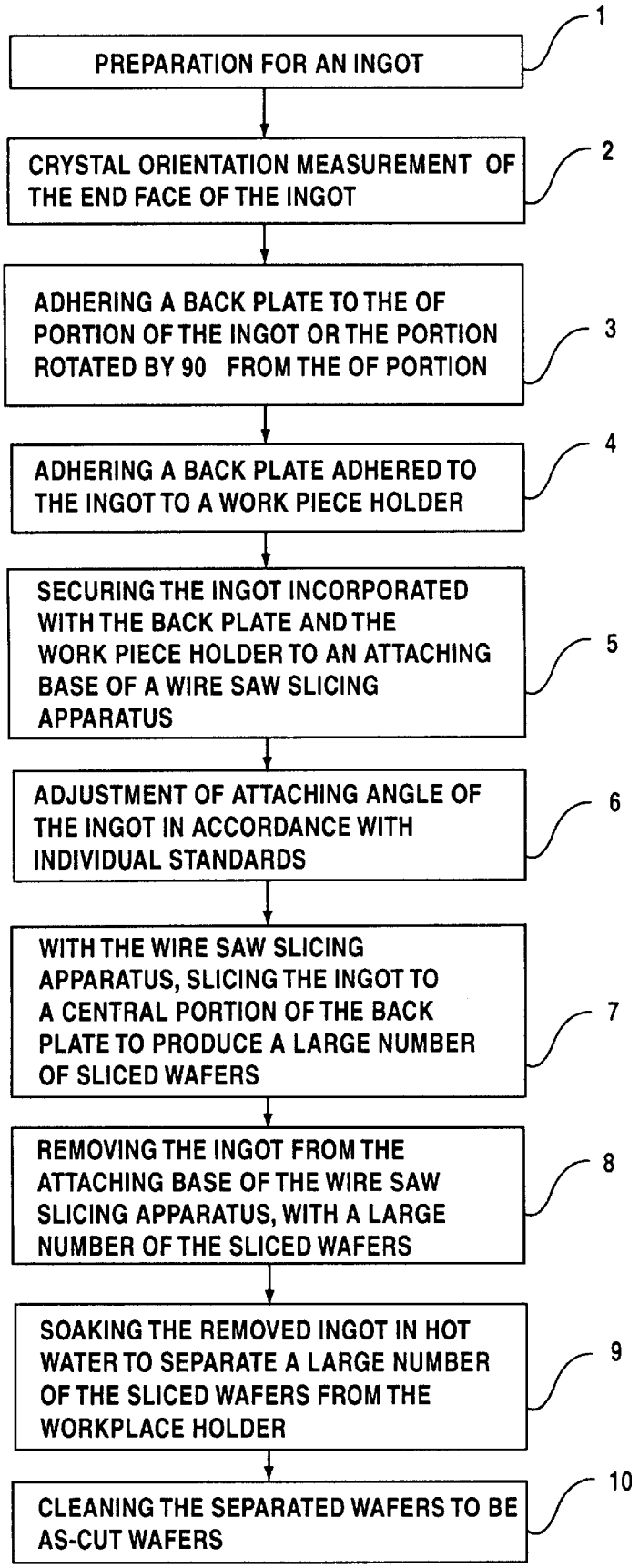
FIG.4 PRIOR ART
FIG. 4 is a flow chart showing a procedure of a conventional method of slicing a semiconductor single crystal ingot.

FIG. 1 shows a procedure of the method according to the present invention. The difference between the procedure of FIG. 1 and the procedure of the conventional method shown in FIG. 4 is that the back plate 41 is adhered to a portion other than the orientation flat portion (OF) or a portion rotated or shifted by 90° from the orientation flat portion (OF) (step 3*a*) after the crystal orientation in the distal end face of the prepared ingot (W) is measured (step 2). The following steps 4 to 10 are the same as those in the conventional procedure.

Thus, in the back plate adhering process of the method according to the present invention, the portion on which the back plate 41 is adhered is changed to the portion which does not coincide with either one of the two cleavage directions ($A_1$, $A_2$) so that the ingot (W) is sliced with the running direction (Y) of the wire 12 being not corresponding with either one of the two cleavage directions ($A_1$, $A_2$) of the ingot (W). Therefore, occurrence of cracks or breakage when slicing or in the wafers sliced can be sufficiently suppressed.

The invention will be further described by way of the following examples which should be construed illustrative rather than restrictive.

EXAMPLE 1

Figure 3:
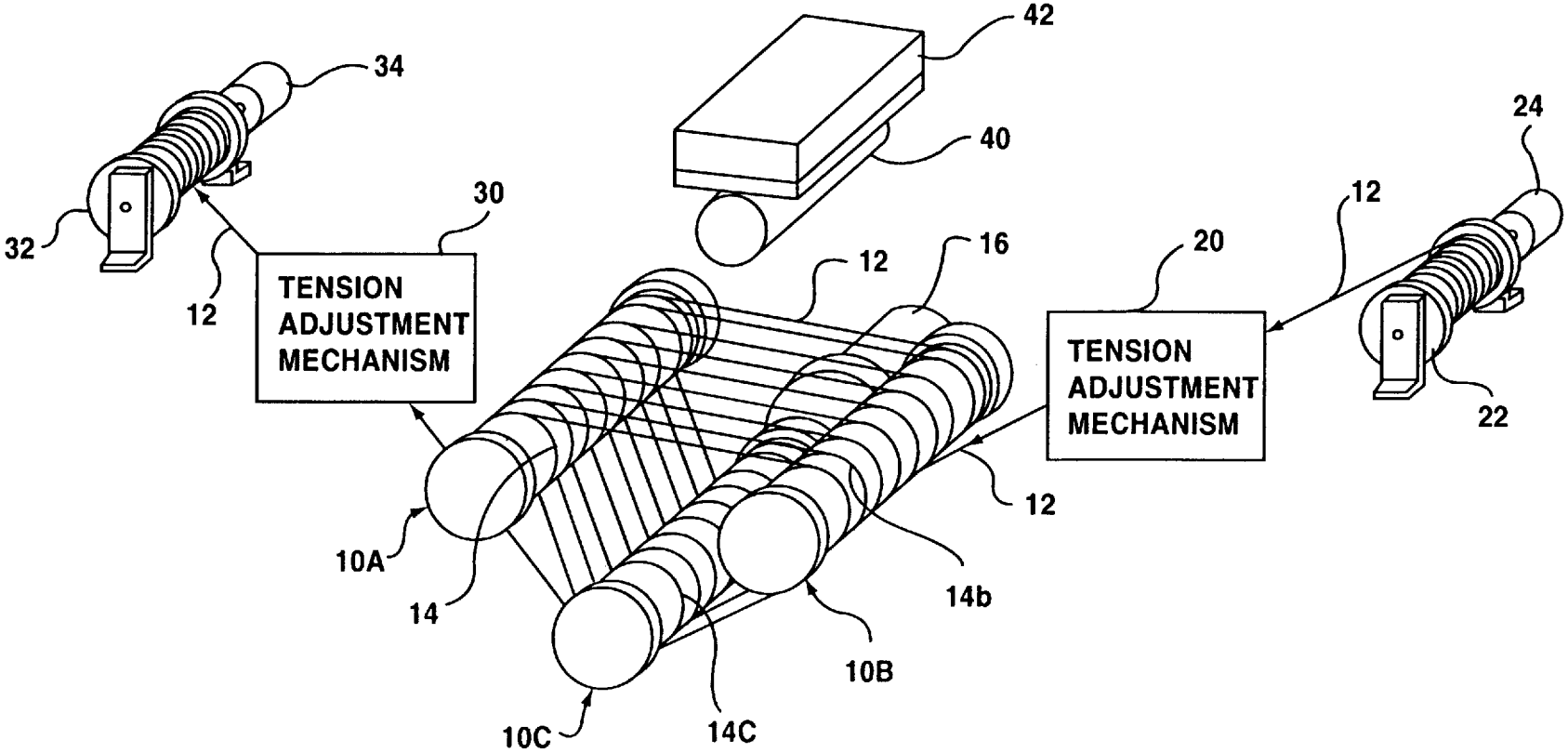
FIG. 3 is a diagramatical perspective view showing a main portion of a wire saw slicing apparatus.

20 pieces of (100) silicon single crystal ingots were sliced by the wire saw slicing apparatus shown in FIG. 3 in accordance with the method of FIG. 1, in which the value of θ was 45° as shown in FIG. 2, and 4965 sheets of wafers were obtained, each wafer having saw marks which are not corresponding with the cleavage directions of the single crystal. The crack generation rates of the wafers of the present invention were measured and the results of the measurements are shown in Table 1.

COMPARATIVE EXAMPLE 1

10 pieces of (100) silicon single crystal ingots were sliced by the same wire saw slicing apparatus as used in Example 1 in accordance with the method of FIG. 4, in which the wire running direction was corresponding with the cleavage direction of the silicon single crystal, and 1975 sheets of wafers were obtained, each wafer having saw marks running in accord with the cleavage direction of the single crystal. Also, the crack generation rates of the wafers sliced according to the conventional method were measured and the results of the measurements are shown in Table 1 together with those of Example 1.

As apparently seen from Table 1, the crack generation rates of the wafers can be greatly decreased by the method of the present invention as compared with the conventional method.

TABLE 1

| | Number of pieces sliced ingots | Number of sheets of wafers | Crack generation rates |
|---|---|---|---|
| Example 1 | 20 | 4965 | 0.1~0.2% |
| Comparative Example 1 | 10 | 1975 | 3.5~5% |

In the above embodiment and Example 1, only the (100) silicon single crystal ingot was used in the slicing process. However, the present invention can provide the same effect also in case of using the (110) or (111) silicon single crystal ingot.

Moreover, in the above description, the present invention is explained using an orientation flat portion in the ingot but the same effect can be obtained also in case of forming a notched portion in the ingot. In the (100) silicon single crystal, the notched portion is also mostly formed in either one of the two cleavage directions ($A_1$, $A_2$).

Accordingly, the method of the present invention can effectively prevent occurrence of cracks or breakage in slicing ingots or in sliced wafers by easy operation without adding any special processes. The semiconductor single crystal wafer of the present invention has saw marks which are not corresponding with any one of the cleavage directions of the semiconductor single crystal, and hence occurrence of cracks and breakage thereof can be suppressed significantly.

Obviously, various minor changes and modifications of the present invention are possible in the light of the above teaching. It is therefore to be understood that within the scope of the appended claims the invention may be practiced otherwise than as specifically described.

What is claimed is:

1. A method of slicing a semiconductor single crystal ingot by a wire saw slicing apparatus, comprising determining the crystal orientation and cleavage directions of the ingot; stationarily mounting the ingot to a wire saw slicing apparatus; and slicing the ingot with a wire of the wire saw slicing apparatus, the running direction of the wire of the wire saw slicing apparatus being substantially constant with respect to a horizontal plane and differing from any of the cleavage directions of the semiconductor single crystal ingot.

2. A method of slicing a semiconductor single crystal ingot according to claim 1, wherein the semiconductor single crystal ingot has a plurality of cleavage directions, and an angle θ defined between the running direction of the wire and any one of the cleavage direction is 5° or more.

3. A semiconductor single crystal wafer produced by slicing the semiconductor single crystal ingot by the method according to claim 1 with the running direction of the wire differing from any of the cleavage directions of the semiconductor single crystal ingot and having only saw marks formed in the wafer surface aligned away from all of the cleavage directions of the semiconductor single crystal.

4. A semiconductor single crystal wafer produced by slicing the semiconductor single crystal ingot by the method according to claim 2 with the running direction of the wire being 5° or more different from any of the cleavage directions of the semiconductor single crystal ingot and having only saw marks formed in the wafer surface aligned away from all of the cleavage directions of the semiconductor single crystal.

* * * * *